United States Patent [19]

Trotter

[11] Patent Number: 4,823,481

[45] Date of Patent: Apr. 25, 1989

[54] MOP HEAD SPREADER ATTACHMENT FOR ENHANCED DRYING

[76] Inventor: Johnny L. Trotter, Box 85E Covington Hwy.,, Slidell, La. 70460

[21] Appl. No.: 938,006

[22] Filed: Dec. 3, 1986

[51] Int. Cl.[4] ..... F26B 9/10

[52] U.S. Cl. ..... 34/239; 34/151

[58] Field of Search ..... 211/65, 66; 15/257 R; 248/110, 112; 34/239, 96, 101, 151

[56] References Cited

U.S. PATENT DOCUMENTS 768,967 8/1904 Swain ..... 34/96

1,329,186 1/1920 Kindig ..... 248/112

*Primary Examiner*—Henry Bennett

*Attorney, Agent, or Firm*—C. Emmett Pugh

[57] ABSTRACT

A mop drier attachment for a mop having a staff with a mop head element at one end, said attachment having a hook element for gripping the staff positioned near the mop head element. The mop head element includes a plurality of strands which are spread apart and flared out for enhanced, expedited drying by the attachment having a periphery defined by a wire having a pair of generally flared portions in a plane generally transverse to the axis of the staff which extend symmetrically to form a pair of generally arc shaped portions lying in a common arc on the plane and extending toward each other and joining together, the arc shaped portions defining a generally curved portion on which the strands are spread and flared apart for drying with each of the strands extending generally radially outward from the staff in a direction generally along a distance of a radius of the curved portion and then hang down in a generally transverse direction by its periphery in a direction generally along the axis of the staff. Included in the mop drier attachment is a shaft portion which extends from the hook element in a direction along the axis of the staff toward the mop head element, with the generally flared portions extending a distance symmetrically outward from the shaft portion.

9 Claims, 1 Drawing Sheet

MOP HEAD SPREADER ATTACHMENT FOR ENHANCED DRYING

BACKGROUND OF INVENTION

1. Field of the Invention

The present invention relates generally to mop driers, and more particularly to an attachment for a mop suitable for enhancing the drying of the mop, in which the strands of the mop head element disposed on an end of a staff are spread out and flared apart over the attachment for enhanced, expedited drying, with each of the strands extending generally radially outward from the mop staff over the attachment and then being allowed to hang in a generally transverse direction, so that the ends of the strands extend in a direction generally along the axis of the staff both parallel to each other and at least generally separated from each other for enhanced, expedited drying, the attachment being attachable to the mop staff near the mop head and for example being made of wire.

2. Prior Art & General Background

Various types of devices and methods for drying items have been in use for a number of years. For example, to dry clothes in the ambient, a usual practice is to hang a garment on a rope or line stretched across a room or outside, or to hang them on the backs of chairs, the edges of bathtubs, the tops of radiators, and on drying racks to name a few, all being a mode of drying which may be described as being of a haphazard fashion. For a drier which may be described as an improvement to the art of drying and which utilizes forms suitable for drying articles of clothes, in which the articles follow the contours of the different forms, so that the articles are properly shaped and only in exceptional cases require ironing, see, for example, U.S. Pat. No. 2,084,854, issued in 1937.

For example of a device for facilitating the warming or drying of gloves which provides a skeleton frame work with a means for standing or hanging up the frame work in such a manner as to adapt it to permit warm air to pass into the interior of a glove, sock, boot or the like to warm or dry the latter, see for example, British Pat. No. 534, issued in 1903.

For other examples of patents relating to mops, see for example U.S. Pat. No. 3,656,207 which provides a mop head holder for a wet mop of the type described in U.S. Pat. No. 2,492,232 which may be readily removably attached to and used with a mop having a clip-type securing member also utilized to support a dry mop of the type described in U.S. Pat. No. 3,029,454. For an exemplary combined mop head and wringer, see for example U.S. Pat. No. 973,491, in which one end of the yarn of the mop is attached to a handle, and the other end is attached to a sleeve which is loosely attached to and encircles the handle, with the sleeve being held stationary in one hand, while the handle is rotated to twist the yarn of the mop to wring it out. For an example of a self-wringing mop mechanism which is manually-reciprocal for compressing or wringing out a water absorbent mopping element of a floor mop, see for example U.S. Pat. No. 3,150,400. For an earlier example of a mop, see for example, U.S. Pat. No. 739,786, in which the strands are securely held against displacement or detachment and the fastening means is covered to prevent contact with adjacent object in any position in which the mop may be used. For an example of a dusting cloth holder in which a series of hooks project laterally from the side of a band having a plain edge and opposite a serrated edge of the band to provide engaging points for the cloth on all sides of the band, in which the hooks enable loose ends of the cloth to be taken up when it is required to have a bulk of cloth for purposes of cleaning, see for example U.S. Pat. No. 538,269.

The foregoing patents, which are not directed to mops, are not considered to be part of the prior art to which the invention pertains, which is the mop drying enhancement art using a spreader attachment, but are mentioned merely for general background information.

The prior patents relating to wet mops as disclosed by, for example, the above mentioned U.S. Pat. Nos. 973,491 and 3,150,400 pertain to the art of wringing the mop out to remove part of the water content from the mop and do not deal with the problem of drying the mop after wringing. Commonly, a mode of drying such as air drying, which may be described as of a haphazard fashion, is used which is time consuming, as circulation of air around the mop strands is generally poor. As may be readily seen, drying in this case may be described as being from the outside in and it may take many hours for a mop to dry in this manner, leading to its rotting and to a condition which may be described as a sour mop. As may be appreciated, no one likes to work with a sour mop nor perhaps having to replace a mop head element every six weeks due to rotting.

To applicant's knowledge, there is no suitable apparatus for enhanced drying of a mop head element, which allows circulation of air around the mop strands to aid in restraining the mop element from rotting and which further restrains the mop element from souring. Further, applicant knows of no art suitable for spreading the strands or yarn of a mop head element apart, so that air circulation may be improved for faster drying.

GENERAL, SUMMARY DISCUSSION OF THE INVENTION

It is an object of the method and apparatus of the present invention to provide a mop staff attachment suitable for drying a mop element, in which the strands of a mop element disposed on an end of a staff may be spread and flared apart for drying so that the mop element may be restrained from rotting and becoming sour. Accordingly, it is a further object of the method and apparatus according to the present invention, that each of the strands extend generally radially outward from the mop staff to then hang down in a generally transverse direction so that the ends of the strands extend in a direction generally along the axis of the staff both parallel to each other and separated for enhanced drying.

Accordingly, it is a further object of the method and apparatus of the present invention to provide an attachment including a means defining a periphery which is suitable for spreading the strands apart. In accordance with this object, the periphery includes a pair of generally flared symmetrical portions which lie in a plane generally transverse to the axis of the staff and which then hang down symmetrically to form a pair of generally arc shaped portions lying in a common arc on the plane and which extend toward each other and join, such that the arc shaped portions define a generally curved portion on which the strands may be spread and flared apart for enhanced drying with each of the strands extending generally radially outward from the staff a distance equal to the radius of the curved portion and bent in a generally transverse direction by the periphery so that the ends of the strands extend in a direction along the axis of the staff both parallel to each other and separated for enhanced drying.

In further accordance with this object, it is a feature of the present invention that the periphery be formed by a wirelike member, and there is further included an opening between the periphery, which is defined by an inner periphery of the wirelike member.

Accordingly, it is a further feature of the present invention that the invention include a hook element for gripping the staff near the mop head element and a shaft portion extending from the hook element in a direction toward the mop element along the axis of the shaft.

The above objects and other features of the present invention will become apparent from the drawings, the description given herein, and the appended claims.

BRIEF DESCRIPTION OF THE DRAWINGS

The invention may be more fully understood by reference to the following description of the preferred embodiment in conjunction with the drawings, wherein.

DESCRIPTION OF THE PREFERRED, EXEMPLARY EMBODIMENTS

Figure 4:
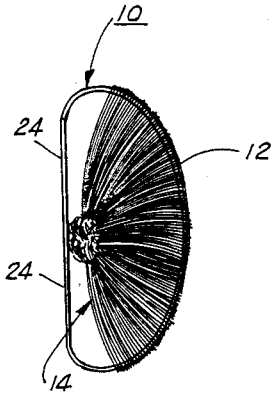
FIG. 4 is a top view of the preferred embodiment shown in FIG. 1, with the mop drier disposed on the staff of the mop with the strands of the mop element spread apart and flared out for enhanced drying.

Referring to the drawings, a first preferred, exemplary embodiment of a mop drier attachment 10 for spreading apart and flaring out the strands 12 of a mop element 14 is seen. The mop head element 14, as generally known to the art, is disposed and attached by a suitable means known to the art to a staff 16, as indicated in the FIG. 1, although other suitable mops having a different configuration may also be used with the mop drier attachment 10 and such is within the scope of the inventive concept herein taught.

Figure 2:
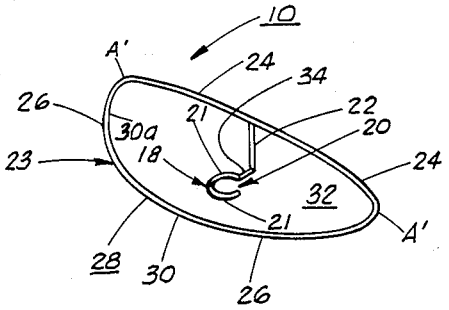
FIG. 2 is an elevational view of the preferred embodiment shown in FIG. 1.
Figure 3A:
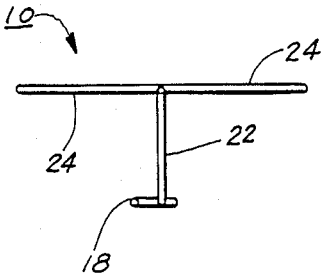
FIG. 3A is a rear view of the preferred, exemplary embodiments, as shown in FIGS. 1 and 5, of a mop drier attachment according to the present invention.
Figure 3B:
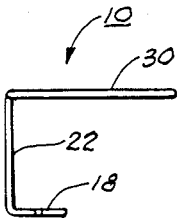
FIG. 3B is a side view of the preferred embodiments, as shown in FIGS. 1 and 5, of a mop drier attachment according to the present invention.

Included in the mop drier attachment 10 is a hook element for gripping staff 16. As shown in FIGS. 2–4, the hook element includes a wire-like portion 18 formed into a hook shape having a suitable dimension such that the positioning of staff 16 near mop element 14 and the insertion of staff 16 through an opening 20 into the hook shaped portion 18 springs wire-like portion 18 outward to grip staff 16. Accordingly, hook shaped portion 18 includes a pair of opposed, curved arms 21 having a convex shape which face outward as shown in the figures. As staff 16 is inserted into hook shaped portion 18, arms 21 are sprung outward by staff 16 so that hook shaped portion 18 may grip staff 16. As may be appreciated, wire-like portion 18 may be made of a suitable plastic or wire which has a spring-like characteristic, and may also be, for example, made of a suitable plastic which is reinforced with a wire element.

A shaft portion 22 extends generally transverse from the hook element and may be formed integral with portion 18, and may include, for example, a reinforcing wire element. With the hook element positioned in a gripping configuration with staff 16, shaft portion 22 would be aligned with the axis of staff and positioned in a configuration such that shaft portion 22 extends from the hook element in a direction toward mop element 14.

Included with mop drier attachment 10 is a means for spreading strands 12 apart. Extending transversely from shaft portion 22, the means, as shown in the preferred embodiment of the figures, defines a periphery 23 lying in a plane generally transverse to the axis of staff 16, and includes a pair of generally flared portions 24 which extend a distance symmetrically outward and transverse from shaft portion 22. As shown in the figures, the flared portions 24 bend in a symmetrical manner, as indicated by A', to form a pair of generally arc shaped portions 26 which lie in a common arc on the plane and extend toward each other and join together such that arc shaped portions 26 define a generally curved portion 28 on which strands 12 may be spread and flared.

As may be further appreciated, periphery 23 may be formed by a wire-like construction 30 which may be plastic and may, for example, be wire reinforced. As further may be appreciated, wire-like construction 30 may be molded together with shaft portion 22 and the hook element and for example the wire reinforcement which may be used may be continuous with the plastic surrounding its periphery to previous rusting of the reinforcements.

With periphery 23 formed by wire-like construction 30 as shown in the figures, an opening 32 is included which is defined by an inner periphery **30*a* of wire-like construction 30. As further shown in the figures, the hook element is configured with its opening 20 facing in a direction with, for example, the axis of staff 16 passing through opening 16 so that mop element 14 may be inserted through opening 32 and spread on curved portion 28 for drying. With mop drier attachment 10 so configured, arc shaped portions 26 and curved portion 28 are in a configuration on one side of staff 16, with flared portions 24 in a configuration on as opposite side of staff 16**.

As shown in the drawings and with shaft portion 22 and wire-like construction 30 so described and shown, shaft portion 22 is configured to extend generally transverse by from wire-like construction 30. With shaft portion 22 and wire-like construction 30 so configured, hook shaped portion 18 may include a configuration which has a shaft 34 which extends from shaft portion 22 inward toward curved portion 28 with hook shaped portion 18 extending from an innermost end **34*a* of shaft 34. With shaft 34 and hook-shaped portion 18 so configured, hook shaped portion 18 has a configuration with opening 20 generally facing radially outward. As shown and described, the configuration allows shaft portion 22 to have a configuration on one side of staff 16, and hook shaped portion 18 to have a configuration on an opposite side of staff 16** for purposes which will be described later.

Figure 1:
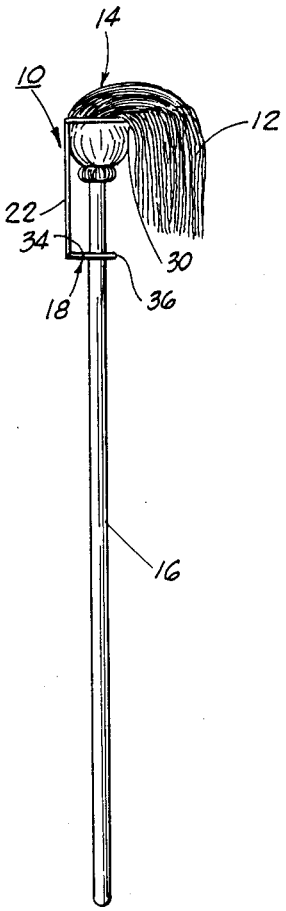
FIG. 1 is a side view of a first preferred, exemplary embodiment of a mop drier attachment according to the present invention, shown with the mop drier attachment disposed on the staff of a mop, with the strands of its mop head element spread apart and flared out for enhanced drying.

As may be appreciated, mop drier attachment 10 allows the user, for example, to dispose staff 16 in a suitable configuration for drying, which as shown in the figures may be a generally vertical position, so that mop element 14 is disposed in an upper configuration to allow mop element 14 to be inserted upward through opening 32. With mop element 14 passed through opening 32, hook shaped element 18 may be positioned near mop element 14 and staff 16 may be inserted through opening 20 into hook shaped element 18. As staff 16 is inserted into hook shaped portion 18 and into its rear curved portion 36, curved arms 21 are sprung outward by staff 16 for gripping engagement with staff 16. With hook shaped element 18 so positioned in a gripping engagement with staff 16, strands 12 may be spread and flared apart for drying as shown in FIGS. 1 and 4 on curved portion 28 with each of the strands 12 extending generally radially outward from staff 16 in a direction generally along a distance of a radius of curved portion 28. With staff 16 dispersed in its vertical position, strands 12 are bent in a generally transverse direction by curved portion 28 so that the ends of strands 12 extend in a direction generally along the axis of staff 16 both parallel to each other and separated for drying.

As may be further appreciated, with staff 16 configured in a vertical position as shown in FIG. 1, the ends of strands 12 would be bent downward by curved portion 28 to lie generally along the axis of staff 16. Accordingly the weight of strands 12 would bear down on curved portion 28. With wire-like construction 30 configured as shown in the figures with shaft portion 22 in its configuration on one side of staff 16 and hook shaped portion 18 in its configuration on the opposite side of staff 16 with its curved portion 36 facing toward curved portion 28, the downward force on curved portion 28 would cause hook shaped portion 18 to accordingly rotate outward to bias curved portion 36 against staff 16 and provide a means for increasing the gripping engagement between hook shaped portion 18 and staff 16. As further may be appreciated, having hook shaped portion 18 configured as shown and described, the weight of mop element 14 is restrained from decreasing the gripping engagement between hook shaped portion 18 and staff 16 and by being so configured, the weight of the strands 12 may be used advantageously to increase the gripping engagement between hook shaped portion 18 and staff 16.

Figure 5:
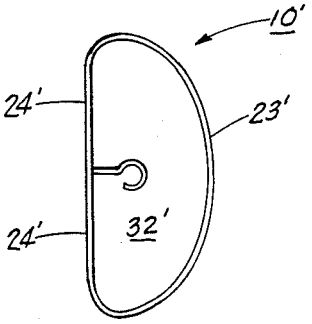
FIG. 5 is a top view of a second preferred, exemplary embodiment of a mop drier attachment according to the present invention.
Figure 3C:
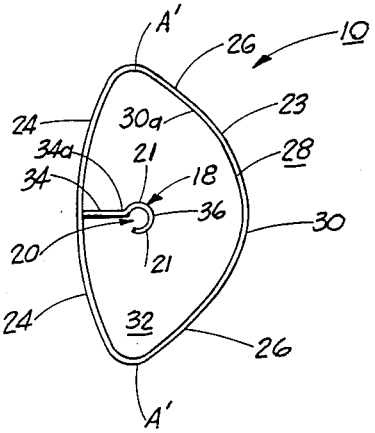
FIG. 3C is a top view of the preferred embodiments, as shown in FIGS. 1 and 5, of a mop drier attachment according to the present invention.

As may further be appreciated, flared portion 24 may have a generally straight configuration or as shown in the first embodiment of FIGS. 2–4, may have a somewhat curved configuration. The flared portion 24' may also bend sharply as best shown in FIGS. 2 and 3C in a transverse direction to form arc shaped portion 26. Further, with a flared portion 24' having a generally straight configuration in a second preferred embodiment of a mop drier attachment 10' as shown in FIG. 5, the mop drier attachment 10' may have a periphery 23' as shown in the figures which may be described as having a "D" configuration.

As may further be appreciated, flared portions 24 may be biased inward against mop element 14, which may for example as shown in the figures have flared portions 24 resting on mop element 14 near its attachment to staff 16, by the downward force on curved portion 28 provided by the weight of strands 12. Accordingly, this would provide a further means so that the weight of mop element 14 is restrained from decreasing the gripping engagement between hook shaped portion 18 and staff 16.

A further exemplary embodiment of the present invention may have, for example, a periphery which includes a curved portion similar to curved portion 28 which may be formed by a flat plate. Accordingly, the plate would have a number of holes in its surface to allow circulation of air for drying, and would be configured with flared portions extending outward from a shaft portion similar to shaft portion 22, which would lie on the same side of a staff of the mop as the curved portion. A hook element for gripping the staff may extend from the shaft portion including a pair of similar curved arms with the opening into the hook shaped portion facing outward from the curved portion of the periphery of the plate, upon which the strands may be spread and flared out for enhanced or expedited drying.

The foregoing disclosure and description of the invention is illustrative and explanatory thereof, and various changes in the method steps as well as in the details of the illustrated and/or described exemplary embodiments may be made within the scope of the appended claims without departing from the spirit of the invention.

What is claimed is:

1. A mop drier system, comprising:

an attachment for drying the strands of a mop head element on a mop;

a mop having a narrow, elongated staff having a mop head element at one of its ends, which mop head element includes a plurality of mopping strands;

said attachment including hook element gripping said narrow, elongated staff positioned near said mop head element;

a shaft portion extending transversely from said hook element in a direction toward said mop head element along the axis of said staff;

spreader means attached to said shaft portion spreading said mop strands apart, said spreader means having a wire-like periphery extending transversely to said shaft portion out away from said staff having a pair of generally flared portions extending a distance outward from said shaft portion in a plane generally transverse to the axis of said staff which extend to form a pair of generally arc shaped portions on said plane and extending toward each other and being joined together, said arc shaped portions defining a generally curved portion on which said strands are spread and flared apart for enhanced, expedited drying in the ambient with said strands extending generally radially outward from said staff in a direction generally along a distance of a radius of said curved portion, and hanging in a generally transverse direction by said spreader means so that the ends of said strands extend in a direction generally along the axis of said staff both parallel to each other and separated for enhanced, expedited drying, said curved portion being disposed in a configuration on one side of said staff, and said hook element means being disposed in a configuration on the opposite side of said staff, the weight of said strands on said curved portion causing said hook element to more firmly grip said staff.

2. The mop drier attachment of claim 1, wherein said hook element includes a shaft which extends from said shaft portion inward toward said curved portion with a hook shaped wire-like portion extending from an innermost end of said shaft.

3. The mop drier attachment of claim 2, wherein said shaft portion has a configuration on one side of the staff and said hook shaped portion has a configuration on an opposite of the staff.

4. The mop drier attachment of claim 3, wherein said configuration of said shaft portion and said configuration of said hook shaped portion provides increased gripping means for increasing the gripping engagement between said hook shaped portion and the staff.

5. The mop drier attachment of claim 2, wherein said hook shaped wire-like portion includes an opening in which the staff may be inserted into said hook shaped wire-like portion.

6. The mop drier attachment of claim 5, wherein said hook-shaped, wire-like portion includes a pair of opposed curved arms having a convex shape which face outward and which are sprung outward by the staff for gripping engagement with the staff.

7. The mop drier attachment of claim 1, wherein said configuration of said mop drier attachment includes having said shaft portion disposed in a generally vertical position, the mop head element being disposed in an upper configuration.

8. The mop drier attachment of claim 1, wherein said shaft portion and said hook element have a configuration providing increased gripping means for increasing the gripping engagement between said hook element and the staff.

9. A method of enhancing and expediting the drying of a wet mop having a narrow elongated staff having a mop head element which includes a plurality of mop strands at one of its ends, comprising the following steps:

(a) providing a mop head drier attachment having hook element means for gripping the narrow, elongated staff near the mop head element;
a staff portion extending from said hook element in a direction toward the mop head element along the axis of the staff; and
spreader means attached to said shaft portion for spreading the mop strands apart, said spreader means defining a periphery having a pair of generally flared portions extending a distance outward from said shaft portion in a plane generally transverse to the axis of said staff which extend to form a pair of generally arc shaped portions on said plane and extending toward each other and joining together, said arc shaped portions defining a generally curved portion;

(b) gripping the narrow, elongated staff which extends from a mop head element in a position near the mop head element with the element means;

(c) positioning the flared portions and the curved portion on opposite sides of the mop element in a configuration having the elongated staff positioned substantially perpendicular between the flared portions and the curved portion; and (d) spreading the mop strands out and flaring the strands apart on said spreader means for enhanced, expedited drying in the ambient with each of the strands extending generally radially outward from the staff in a direction generally along a distance of a radius of said curved portion and hanging in a generally transverse direction by said spreader means so that the ends of the strands extend in a direction generally along the axis of the staff both parallel to each other and separated for enhanced, expedited drying of the mop strands.

* * * * *